United States Patent [19]

Endo et al.

[11] Patent Number: 4,686,110

[45] Date of Patent: Aug. 11, 1987

[54] METHOD FOR PREPARING A THIN-FILM ELECTROLUMINESCENT DISPLAY PANEL COMPRISING A THIN METAL OXIDE LAYER AND THICK DIELECTRIC LAYER

[75] Inventors: Yoshihiro Endo; Etsuo Mizukami; Hiroshi Kishishita, all of Nara; Hisashi Uede, Wakayama, all of Japan

[73] Assignee: Sharp Kabushiki Kaisha, Osaka, Japan

[21] Appl. No.: 824,861

[22] Filed: Jan. 31, 1986

Related U.S. Application Data

[62] Division of Ser. No. 435,917, Oct. 22, 1982.

[30] Foreign Application Priority Data

Oct. 22, 1981 [JP] Japan ..... 56-169616

[51] Int. Cl.[4] ..... B05D 3/06

[52] U.S. Cl. ..... 427/38; 427/66; 427/69; 427/70; 427/109; 427/126.2; 427/126.3; 427/126.4

[58] Field of Search ..... 427/66, 69, 38, 70, 427/109, 126.2, 126.3, 126.4

[56] References Cited

U.S. PATENT DOCUMENTS

| | | | |
|---|---|---|---|
| 4,418,118 | 11/1983 | Lindors | 427/66 X |
| 4,454,166 | 6/1984 | Abe et al. | 427/39 X |
| 4,455,351 | 6/1984 | Camlibel et al. | 427/39 X |

*Primary Examiner*—Bernard D. Pianalto

*Attorney, Agent, or Firm*—Birch, Stewart, Kolasch and Birch

[57] ABSTRACT

A thin-film electroluminescent (EL) display panel comprises a thin-film EL layer, first and second dielectric layers, the thin-film EL layer being disposed between the dielectric layers, first and second metal oxide layers, and first and second electrodes, the first and second metal oxide layers being disposed respectively between the first and second dielectric layers, and the first and second electrodes. Preferably, at least one of the first and second metal oxide layers is made of $Al_2O_3$, $SiO_2$ or the like with a thickness of about 100–800Å and at least one of the dielectric layers being about 1000–3000Å.

7 Claims, 4 Drawing Figures

METHOD FOR PREPARING A THIN-FILM ELECTROLUMINESCENT DISPLAY PANEL COMPRISING A THIN METAL OXIDE LAYER AND THICK DIELECTRIC LAYER

This application is a divisional of copending application Ser. No. 435,917, filed on Oct. 22, 1982.

BACKGROUND OF THE INVENTION

The present invention relates to a thin-film electroluminescent display panel (referred to as "EL display panel" hereinafter) and, more particularly, to dielectric layers suitable for the EL display panel.

Recently, an $Si_3N_4$ film known as an amorphous thin film has been adapted for a dielectric layer for the EL display panel because of high resistivity to moisture invading and high resistance to an applied voltage.

However, the $Si_3N_4$ film has the disadvantage that the adhesion strength to the other layers of the EL display panel is weak and an interface level tends to be generated. The weak adherence strength may lead to detaching the $Si_3N_4$ film from the other layers. The interface level causes an electroluminescence emission starting voltage to become irregular over an emission surface of an electroluminescence layer.

To reduce the effect by the above defects, the surface of a substrate on which the $Si_3N_4$ film is formed must be very clean and smooth. However, such requirement is disadvantageous for mass production with factory equipment that is not expensive.

SUMMARY OF THE INVENTION

Accordingly, it is an object of the present invention to provide an improved EL display panel.

It is another object of the present invention to provide improved dielectric layers suitable for the EL display panel.

Briefly described, in accordance with the present invention, a thin-film electroluminescent (EL) display panel comprises a thin-film EL layer, first and second dielectric layers, the thin-film EL layer being disposed between the dielectric layers, first and second metal oxide layers, and first and second electrodes, the first and second metal oxide layers being disposed respectively between the first and second dielectric layers, and the first and second electrodes.

Preferably, at least one of the first and the second metal oxide layers is made of $Al_2O_3$, $SiO_2$ or the like with a thickness of about 100–800 Å.

BRIEF DESCRIPTION OF THE DRAWINGS

The present invention will become more fully understood from the detailed description given hereinbelow and accompanying drawings which are given by way of illustration only, and thus are not limitative of the present invention and wherein.

DESCRIPTION OF THE INVENTION

The reliability of an EL display panel greatly depends upon the resistance of the EL display panel to an applied voltage.

An X-Y matrix type electrode EL display panel comprises transparent electrodes and counter electrodes which cross at a right angle in a plan view. Unsymmetrical pulses are applied to the X-Y matrix type electrode EL display panel, preferably. Hence, the high resistance of the EL display panel to the applied voltage is prefered. When an DC voltage larger than a threshold level ($V_D$) is applied to the EL display panel, dielectric breakdown of the EL display panel is generated. The threshold level $V_D$ can be raised by interposing an $SiO_2$ film or an $Al_2O_3$ film between a $Si_3N_4$ film and an electrode according to the present invention.

Figure 1:
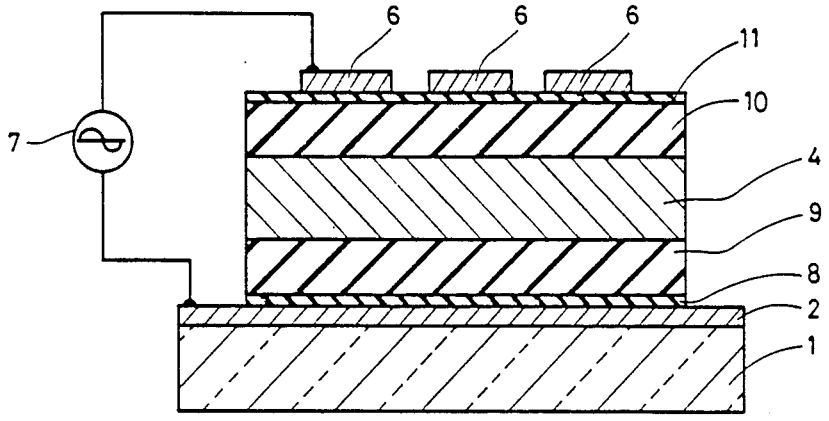
FIG. 1 shows a cross sectional view of an EL display panel according to the present invention.

FIG. 1 shows a cross-sectional view of the EL display panel according to the present invention.

On a transparent glass substrate 1, a plurality of transparent electrodes 2 are formed which are made of $SnO_2$, $In_2O_3$ or the like. The electrodes 2 are positioned like stripes with etching. On the electrodes 2, a first metal oxide film 8 and a first dielectric layer 9 are layered. The first metal oxide film 8 is made of $SiO_2$ or the like with a thickness of about 100–800 Å. The first dielectric layer 9 is an amorphous film composed of $Si_3N_4$.

On the first dielectric layer 9, a ZnS EL layer 4 is deposited whibh is made of a ZnS film doped with Mn at an amount of about 0.1–2.0 wt %. The ZnS EL layer 4 is formed with a thickness of about 5000–9000 Å by electron beam evaporation. A ZnS:Mn sintered pellet is evaporated by electron beam evaporation in a vacuum of about $10^{-7}$–$10^{-3}$ torr to form the ZnS EL layer 4.

To add a hysteresis memory property to the EL display panel, the density of Mn in the ZnS EL layer 4 must be controlled. Experiments indicate that the hysteresis memory property emerges when the density of Mn in the evaporation pellet used to form the ZnS EL layer 4 is 0.5 wt % or more. The effect of the hysteresis memory is enhanced as the density of Mn is increased. While the density of Mn is low in the ZnS EL layer 4, Mn serves as a luminescent center.

When the density of Mn is 0.5 wt % or more, Mn can be precipitated in the interface between the ZnS layer and the dielectric layers or the grain boundary of the ZnS layer. Then, relatively deep electron trap levels are provided resulting in the hysteresis memory property between an applied voltage and emission brightness.

On the ZnS EL layer 4, a second dielectric layer 10 and a second metal oxide film 11 are layered. The second dielectric layer 10 is an amorphous film made of $Si_3N_4$. The second metal oxide film 11 is made of $SiO_2$, $Al_2O_3$ or the like with a thickness of about 100–800 Å. On the second metal oxide film 11, a plurality of counter electrodes 6 are disposed like stripes. An AC electric field is applied to the transparent electrode 2 and the counter electrode 6 by an AC power source 7.

The glass substrate 1 is a 7059 Pyrex chemical resistance glass or the like. The first and the second dielectric layers 9 and 10 are formed by sputtering, plasma Chemical Vapor Deposition (CVD) or the like with a thickness of about 1000–3000 Å. The first and the second metal oxide films 8 and 11 are formed by electron beam evaporation, sputtering, CVD or the like.

In place of $Si_3N_4$, the first and the second dielectric layers 9 and 10 may be made of a silicon-oxynitride film comprising a $Si_3N_4$ film doped with a very small amount of oxygen atoms.

Figure 2:
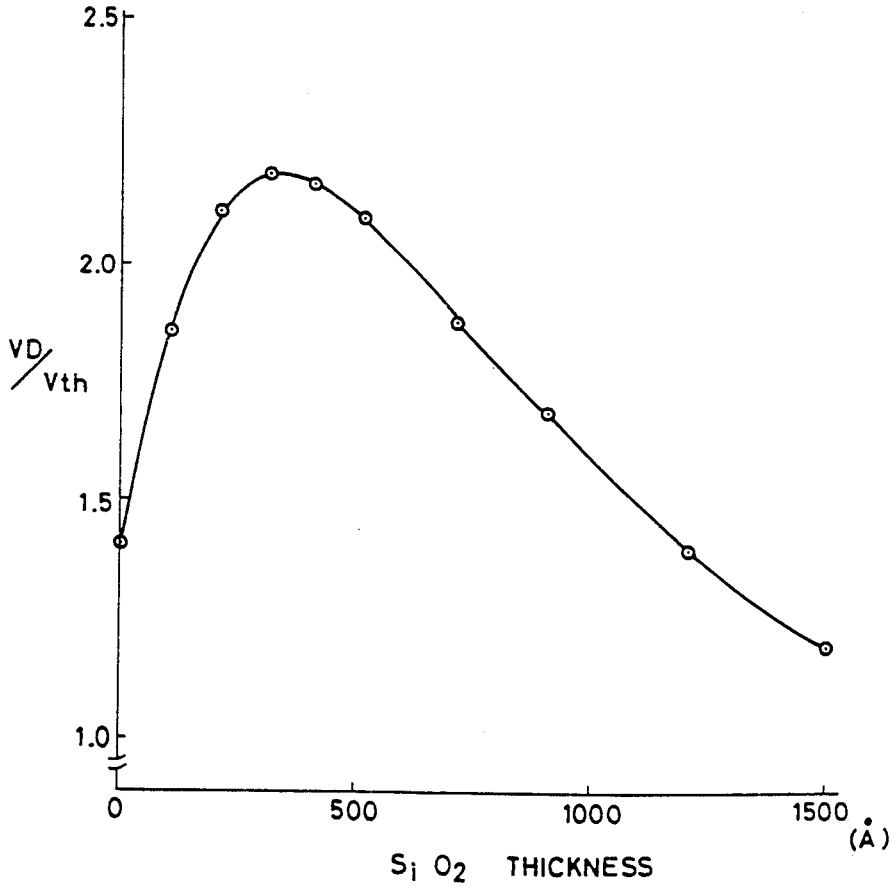
FIGS. 2 through 4 show a graph representing dielectric properties of the EL display panel as shown in FIG. 1.
Figure 3:
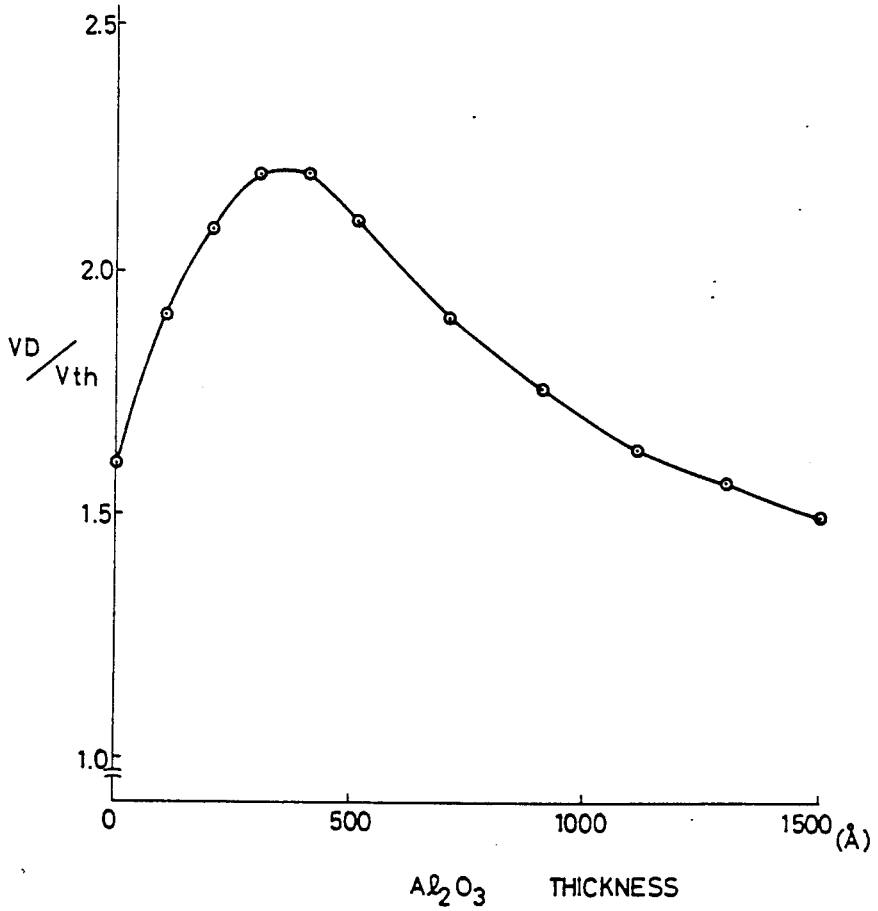
Figure 4:
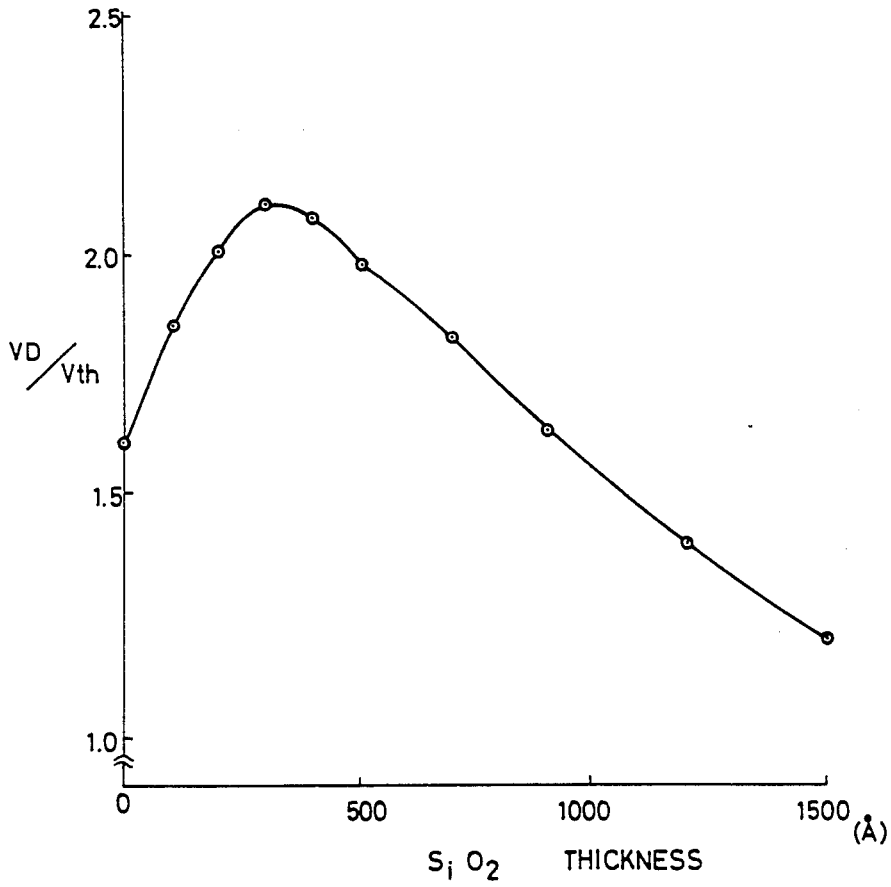

FIGS. 2 through 4 show a graph representing the relationship between the thickness of the first and the second metal oxide films 8 and 11 and the dielectric properties.

An emission starting voltage ($V_{th}$) is defined as a voltage for providing brightness of an emission of 1 ft-L when the AC pulses of 100 Hz with a pulse width of 40 μsec are applied. The dielectric properties are evaluated in terms of $V_D/V_{th}$. As the value of $V_D/V_{th}$ is larger, the dielectric properties or the resistivity to the applied voltage is high.

FIG. 2 is related to the thickness of the first metal oxide film 8 vs. the dielectric property. The EL display panel as shown in FIG. 1 is used comprising the transparent electrode 2 composed of ITO film containing $In_2O_3$ as the principal constituent. The first dielectric layer 9 made of $Si_3N_4$ has a thickness of about 2000 Å. The ZnS EL layer 4 has a thickness of about 7000 Å. The second dielectric layer 10 made of $Si_3N_4$ has a thickness of about 1500 Å. The first metal oxide film 8 is made of $SiO_2$. The second metal oxide film 11 made of $Al_2O_3$ has a thickness of about 400 Å. The counter electrodes 6 are made of Al.

While the thickness of the other layers is fixed, the thickness of the first metal oxide film 8 is varied as shown in the graph of FIG. 2. The thickness of the first metal oxide film 8 of about 300 Å provides a maximum value of $V_D/V_{th}$.

When the thickness of the first metal oxide film 8 is zero and, in other words,the first metal oxide film 8 is absent and only the first dielectric layer 9 is provided under the ZnS EL layer 4, the dielectric resistivity is made low. On the other hand, when the thickness of the first metal oxide film 8 is too large, the dielectric resistivity is made low, also.

In practice, preferably, $V_D/V_{th}$ should be equal to 1.7 or more, so that the thickness of the first metal oxide film 8 made of $SiO_2$ is about 100–800 Å.

FIG. 3 is related to the case where the EL display panel of FIG. 1 comprises the first metal oxide film 8 fixed to be about 300 Å, and the second metal oxide film 11 the thickness of which is varied. Other limitations are the same as the case of FIG. 2.

The second metal oxide film 11 is made of $Al_2O_3$ and is positioned between the counter electrodes 6 and the second dielectric layer 10 made of $Si_3N_4$. A preferable dielectric resistivity is obtained when the thickness of the second metal oxide film 11 is about 100–800 Å as indicated in the graph of FIG. 3.

However, it may be noted that the effect on the improvement of the dielectric resistivity is attributed to the thickness of the first metal oxide film 8 as compared with the effect on the improvement by the thickness of the second metal oxide film 11.

FIG. 4 is related to the case where the second metal oxide film 11 is made of $SiO_2$ in place of $Al_2O_3$ in the graph of FIG. 3. Similar results are obtained in the graph of FIG. 4.

It may be evident that the first metal oxide film 8 can be made of $Al_2O_3$ for the present invention.

As described above, in accordance with the present invention, while uniform emission of the electroluminescence is assured by providing the first and the second dielectric layers 9 and 10 made of $Si_3N_4$, the first and the second metal oxide films 8 and 11 are positioned between the $Si_3N_4$ layers and the elctrode means. The first and the second metal oxide films 8 and 11 are made of $SiO_2$, $Al_2O_3$ or the like with a thickness of about 100–800 Å. The provision of the first and the second metal oxide films 8 and 11 improves the dielectric resistivity.

The reasons for the above effect are believed to be as follows:

The metal oxide film is highly crystallized. Therefore, the highly crystallized metal oxide film and the amorphous $Si_3N_4$ film are layered to thereby improve their adhesion.

The possibility of overlapping the defects such as pin-holes and micro-cracks in the dielectric layers is minimized thereby improving the dielectric resistivity of the EL display panel. In view of the fact that the metal oxide film is so thick the dielectric resistivity is reduced, the increment of the dielectric resistivity owing to high crystallization appears to exceed the increment of the dielectric resistivity owing to the improvement of the adhesion.

Suitable materials for the metal oxide films may be substituted for $Al_2O_3$ and $SiO_2$ although $Al_2O_3$ and $SiO_2$ are only specifically described above.

While only certain embodiments of the present invention have been described, it will be apparent to those skilled in the art that various changes and modifications may be made therein without departing from the spirit and scope of the invention as claimed.

What is claimed is:

1. A method for preparing a thin-film electroluminescent (EL) display panel comprising the steps of:

providing a first electrode on a surface of a transparent substrate;

providing a first insulating oxide layer on said first electrode;

forming a first dielectric layer on said first insulating oxide layer;

depositing an electroluminescent layer on said first dielectric layer;

forming a second dielectric layer on said electroluminescent layer by plasma chemical vapor deposition (CVD);

providing a second insulating oxide layer on said second dielectric layer; and providing a second electrode on said second insulating oxide layer.

2. The method of claim 1, wherein at least one of said first and second insulating oxide layers is a metal oxide film which improves the dielectric resistivity of said display panel.

3. The method of claim 2, wherein said at least one metal oxide film is selected from at least one of $SiO_2$ and $Al_2O_3$, said film having a thickness of from about 100–800 Å.

4. The method of claim 2, wherein said at least one metal oxide film is formed by chemical vapor deposition.

5. The method of claim 1, wherein said first and second dielectric layers comprise at least one of a $Si_3N_4$ and silicon-oxynitride film having a thickness of from about 1000–3000 Å.

6. The method of claim 1, wherein said first electrode comprises transparent etched stripes and said second electrode comprises a plurality of counter electrode stripes which cross at right angles to form an X-Y matrix type EL display panel.

7. The method of claim 1, wherein said electroluminescent layer comprises a ZnS film doped with Mn, said layer having a thickness of from about 5000–9000 Å by electron beam evaportation.

* * * * *